US010852029B2

(12) United States Patent
Tsai et al.

(10) Patent No.: US 10,852,029 B2
(45) Date of Patent: Dec. 1, 2020

(54) WINDOW-SHADES MECHANISM WITH AN ANTI-BACKFLOW FUNCTION, RELATED FAN DEVICE AND ELECTRONIC APPARATUS

(71) Applicant: Wistron Corporation, New Taipei (TW)

(72) Inventors: Chi-Ken Tsai, New Taipei (TW); Xiao-Ju Huang, New Taipei (TW)

(73) Assignee: Wistron Corporation, New Taipei (TW)

( * ) Notice: Subject to any disclaimer, the term of this patent is extended or adjusted under 35 U.S.C. 154(b) by 102 days.

(21) Appl. No.: 16/231,606

(22) Filed: Dec. 24, 2018

(65) Prior Publication Data

US 2020/0116385 A1 Apr. 16, 2020

(30) Foreign Application Priority Data

Oct. 10, 2018 (CN) ..... 2018 1 1178128

(51) Int. Cl.
*F24F 13/075* (2006.01)

(52) U.S. Cl.
CPC ..... *F24F 13/075* (2013.01)

(58) Field of Classification Search
CPC ..... H05K 7/2013; F04D 25/14
USPC ..... 454/184, 259, 353, 359
See application file for complete search history.

(56) References Cited

U.S. PATENT DOCUMENTS 8,120,910 B2 * 2/2012 Hong ..... H05K 7/20181 361/695
2003/0101653 A1 * 6/2003 Biro ..... E06B 7/086 49/74.1

FOREIGN PATENT DOCUMENTS

| | | | |
|---|---|---|---|
| CN | 1129829 | C | 12/2003 |
| CN | 203590649 | | 5/2014 |
| CN | 205778361 | U | 12/2016 |
| GB | 2540356 | A | 1/2017 |
| TW | M391269 | U1 | 10/2010 |
| TW | I547234 | | 8/2016 |

* cited by examiner

*Primary Examiner* — Vivek K Shirsat
(74) *Attorney, Agent, or Firm* — Winston Hsu

(57) ABSTRACT

A window-shades mechanism with an anti-backflow function is applied to a fan device and an electronic apparatus. The window-shades mechanism includes a supporter, a blade, a shaft and a connecting rod. The blade is disposed inside the supporter and includes two sides. Each side includes a first region and a second region. The shaft is connected to the supporter and the blade. The connecting rod is connected to the second region on the side of the blade. The connecting rod has a holding portion. When the connecting rod is moved by the holding portion, the blade is driven to rotate relative to the supporter via the shaft.

20 Claims, 12 Drawing Sheets

WINDOW-SHADES MECHANISM WITH AN ANTI-BACKFLOW FUNCTION, RELATED FAN DEVICE AND ELECTRONIC APPARATUS

BACKGROUND OF THE DISCLOSURE

1. Field of the Disclosure

The present disclosure relates to a window-shades mechanism, a fan device and an electronic apparatus, and more particularly, to a window-shades mechanism, a fan device and an electronic apparatus with an anti-backflow function.

2. Description of the Prior Art

A conventional fan mechanism includes a housing, a fan unit and a window-shades module. The housing has a sunken structure configured to accommodate the fan unit. A lateral wall of the housing has an opening structure where airflow can pass by. The window-shades module is disposed on the lateral wall of the housing and aligns with the opening structure. When the fan unit is turned off, blades of the window-shades module are lowered down to cover the opening structure, so the airflow cannot pass through the opening structure. When the fan unit is turned on, wind force generated by the fan unit can lift the blades of the window-shades module to expose the opening structure, therefore the airflow can pass through the opening structure. However, the conventional fan mechanism cannot provide preferred heat dissipating efficiency because a part of the wind force generated by the fan unit is consumed for lifting the blades of the window-shades module.

SUMMARY OF THE DISCLOSURE

The present disclosure provides a window-shades mechanism, a fan device and an electronic apparatus with an anti-backflow function for solving above drawbacks.

According to the present disclosure, a window-shades mechanism with an anti-backflow function includes a supporter, a blade, a shaft and a connecting rod. The blade is disposed inside the supporter and includes two sides. Each side has a first region and a second region adjacent to each other. The shaft is connected to the supporter and the first region of the side of the blade. The connecting rod is connected to the second region of the side of the blade. The connecting rod has a holding portion. The connecting rod rotates the blade relative to the supporter via the shaft when the holding portion is moved by an external force.

According to the present disclosure, a fan device with an anti-backflow function includes a housing, at least one window-shades mechanism and a fan unit. The housing has a first wall and a second wall opposite to each other. The first wall and the second wall respectively includes a hole structure. The window-shades mechanism is disposed on one of the first wall and the second wall and corresponds to the hole structures. The window-shades mechanism includes a supporter, a blade, a shaft and a connecting rod. The supporter is connected to the housing. The blade is disposed inside the supporter and includes two sides. Each side has a first region and a second region adjacent to each other. The shaft is connected to the supporter and the first region of the side of the blade. The connecting rod is connected to the second region of the side of the blade. The connecting rod has a holding portion. The fan unit is detachably disposed inside the housing. The connecting rod rotates the blade relative to the supporter via the shaft when the fan unit presses the holding portion to move the connecting rod.

According to the present disclosure, an electronic apparatus with an anti-backflow function includes a base and a fan device. The base has a first area, a second area and a third area connected to each other. The fan device is disposed on the second area. The fan device includes a housing, at least one window-shades mechanism and a fan unit. The housing has a first wall and a second wall opposite to each other. The first wall and the second wall respectively includes a hole structure. The window-shades mechanism is disposed on one of the first wall and the second wall and corresponds to the hole structures. The window-shades mechanism includes a supporter, a blade, a shaft and a connecting rod. The supporter is connected to the housing. The blade is disposed inside the supporter and includes two sides. Each side has a first region and a second region adjacent to each other. The shaft is connected to the supporter and the first region of the side of the blade. The connecting rod is connected to the second region of the side of the blade. The connecting rod has a holding portion. The fan unit is detachably disposed inside the housing and located between the hole structures of the first wall and the second wall. The connecting rod drives the blade to rotate relative to the supporter via the shaft when the fan unit presses the holding portion and moves the connecting rod, so as to move the blade away from the hold structures and to connect the first area and the third area.

The window-shades mechanism of the present disclosure can connect the connecting rod with the plurality of blades, and the plurality of blades can be simultaneously and automatically rotated when the connecting rod is pushed by the fan unit. The blades can be automatically recovered in response to a removal of the fan unit. The window-shades mechanism can utilize one of the resilient component and the weighting component to recover the blades, or can utilize both the resilient component and the weighting component to recover the blades.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
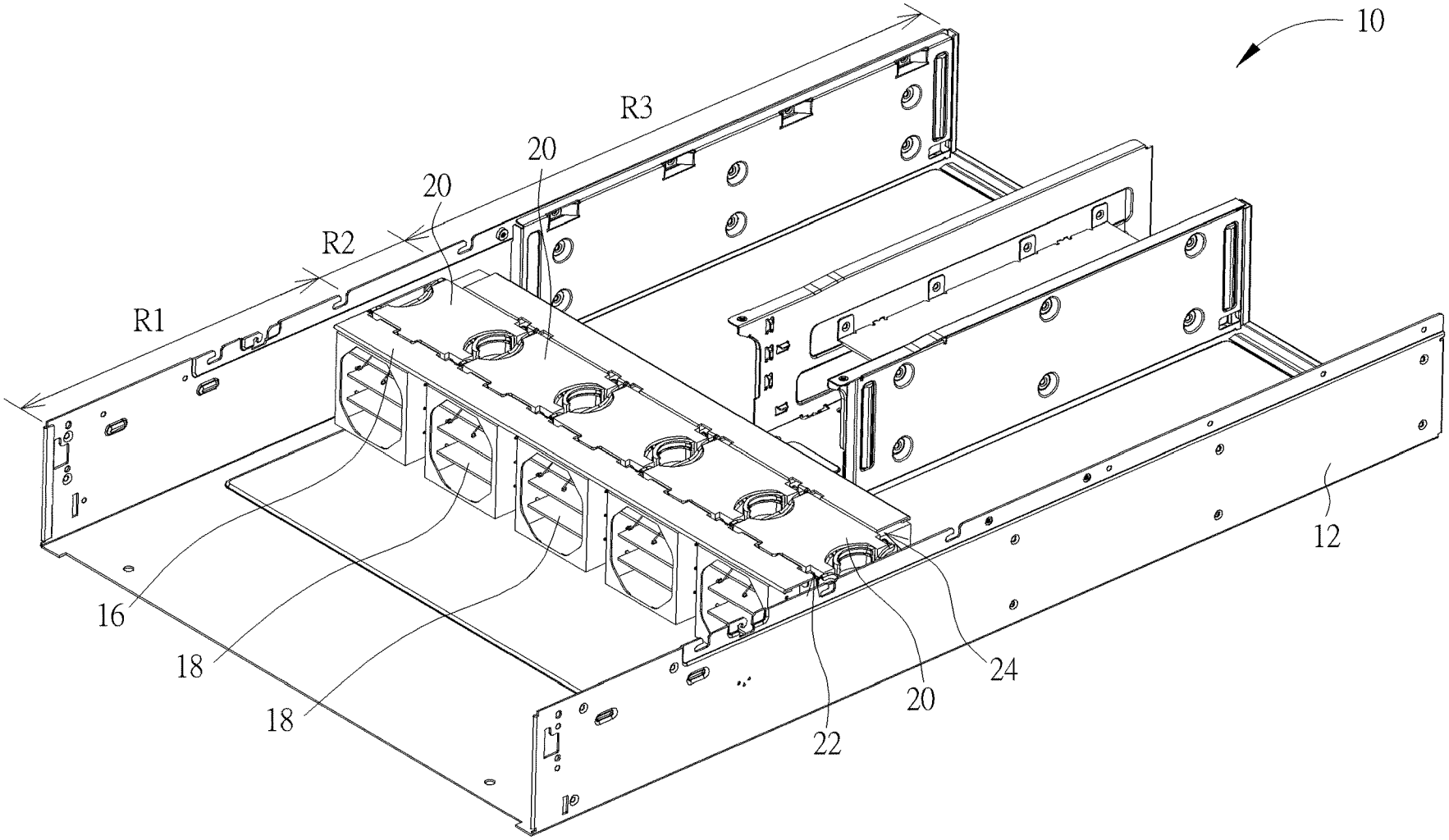
FIG. 1 is a diagram of an electronic apparatus in accordance with an embodiment of the present disclosure.
Figure 2:
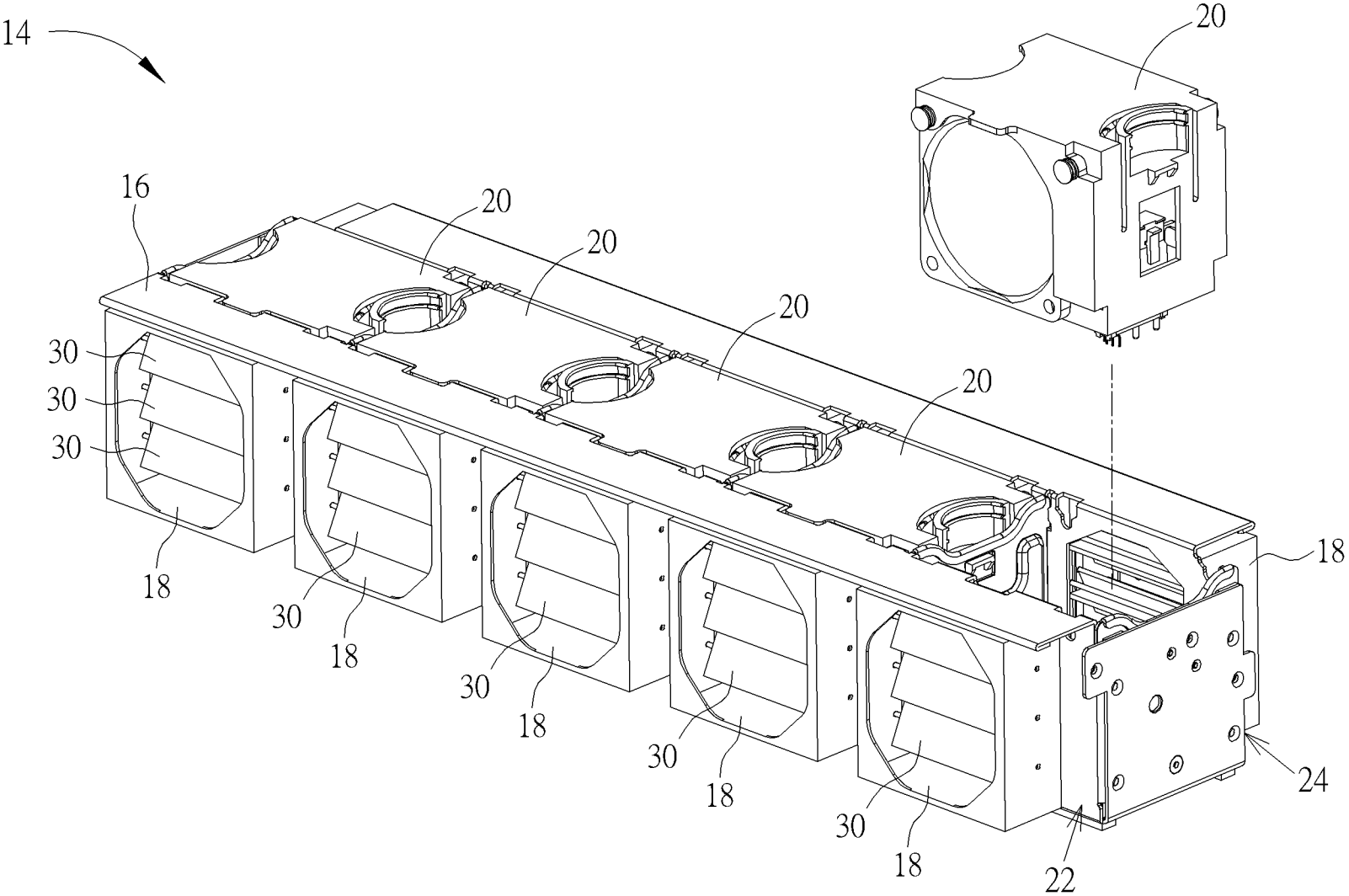
FIG. 2 is an assembly diagram of a fan device in accordance with the embodiment of the present disclosure.
Figure 3:
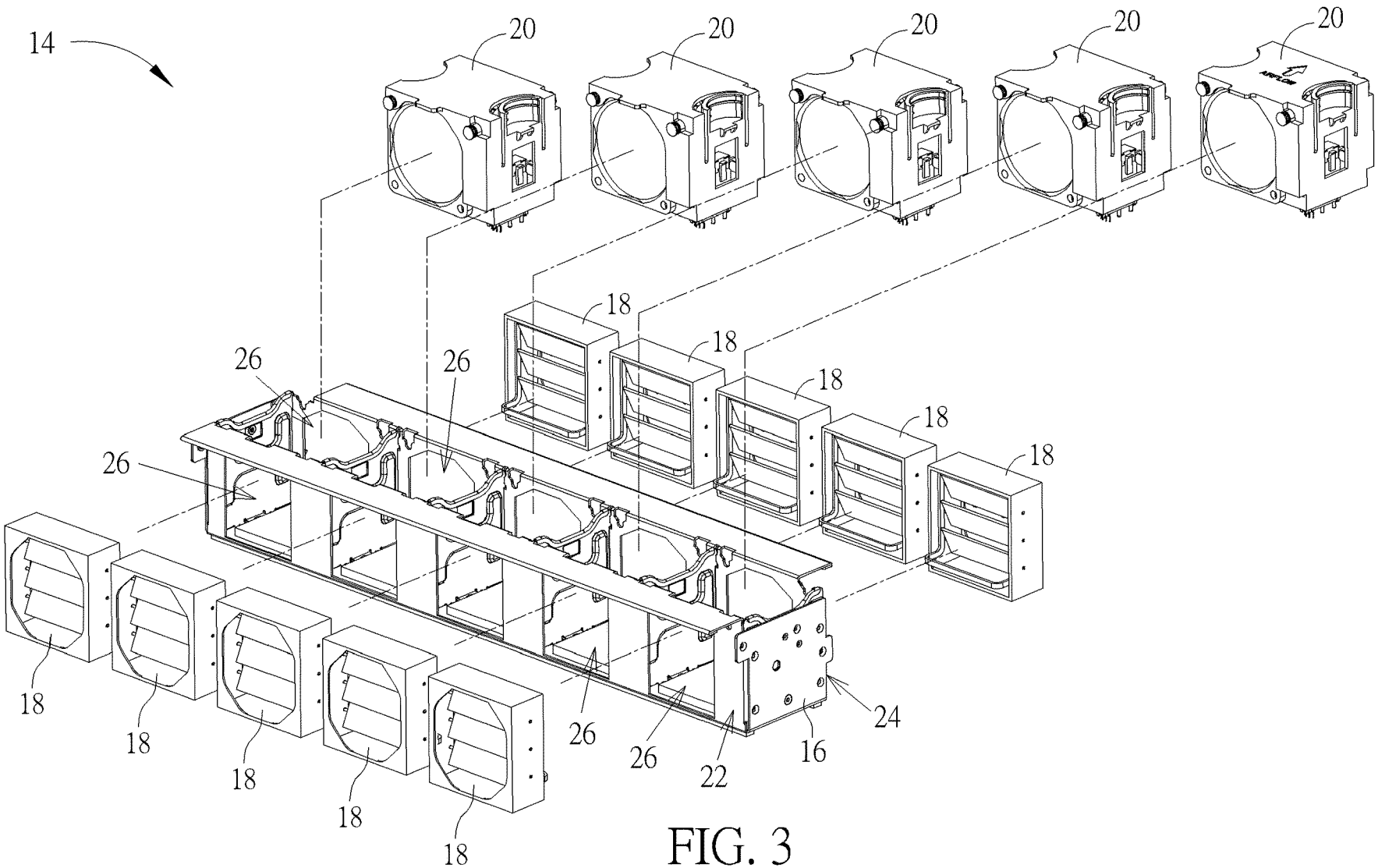
FIG. 3 is an exploded diagram of the fan device in accordance with the embodiment of the present disclosure.

Please refer to FIG. 1 to FIG. 3. An electronic apparatus 10 can include a base 12 and a fan device 14. The base 12 can be divided into a first area R1, a second area R2 and a third area R3 connected to each other. The fan device 14 can be disposed on the second area R2. When the fan device 14 is operated, airflow can pass through the first area R1 and the third area R3. Generally, the airflow is one way transfer from the first area R1 to the third area R3, or from the third area R3 to the first area R1, which depends on design demand. The fan device 14 can include a housing 16, a window-shades mechanism 18 and a fan unit 20. The window-shades mechanism 18 can be assembled with the housing 16. When the fan unit 20 is installed into the housing 16, the window-shades mechanism 18 can be automatically actuated to open blades 30, and an airflow channel between the first area R1, the second area R2 and the third area R3 may be connected.

In the embodiment, the housing 16 can have a first wall 22 and a second wall 24 opposite to each other, and the first wall 22 and the second wall 24 respectively has a hole structure 26. An amount of the hole structure 26 may equal an amount of the window-shades mechanism 18. Each window-shades mechanism 18 can be embedded in the corresponding hole structure 26. The fan unit 20 can be detachably disposed inside the housing 16, and located between two opposite window-shades mechanisms 18. As the fan unit 20 is not in the housing 16, the window-shades mechanism 18 located at the first wall 22 can turn off the blade 30 to cover the hole structure 26 for isolating the first area R1 from the second area R2, and the window-shades mechanism 18 located at the second wall 24 can turn off the blade 30 to cover the hole structure 26 for isolating the second area R2 from the third area R3, so as to prevent the airflow from turbulence. As the fan unit 20 is installed inside the housing 16, the blade 30 of the window-shades mechanism 18 can be lifted to expose the hole structure 26. It should be mentioned that amounts and positions of the fan unit 20 and the window-shades mechanism 18 are not limited to the above-mentioned embodiment; for example, the window-shades mechanism 18 may be only disposed on one of the first wall 22 and the second wall 24 corresponding to the related hole structure 26.

Figure 4:
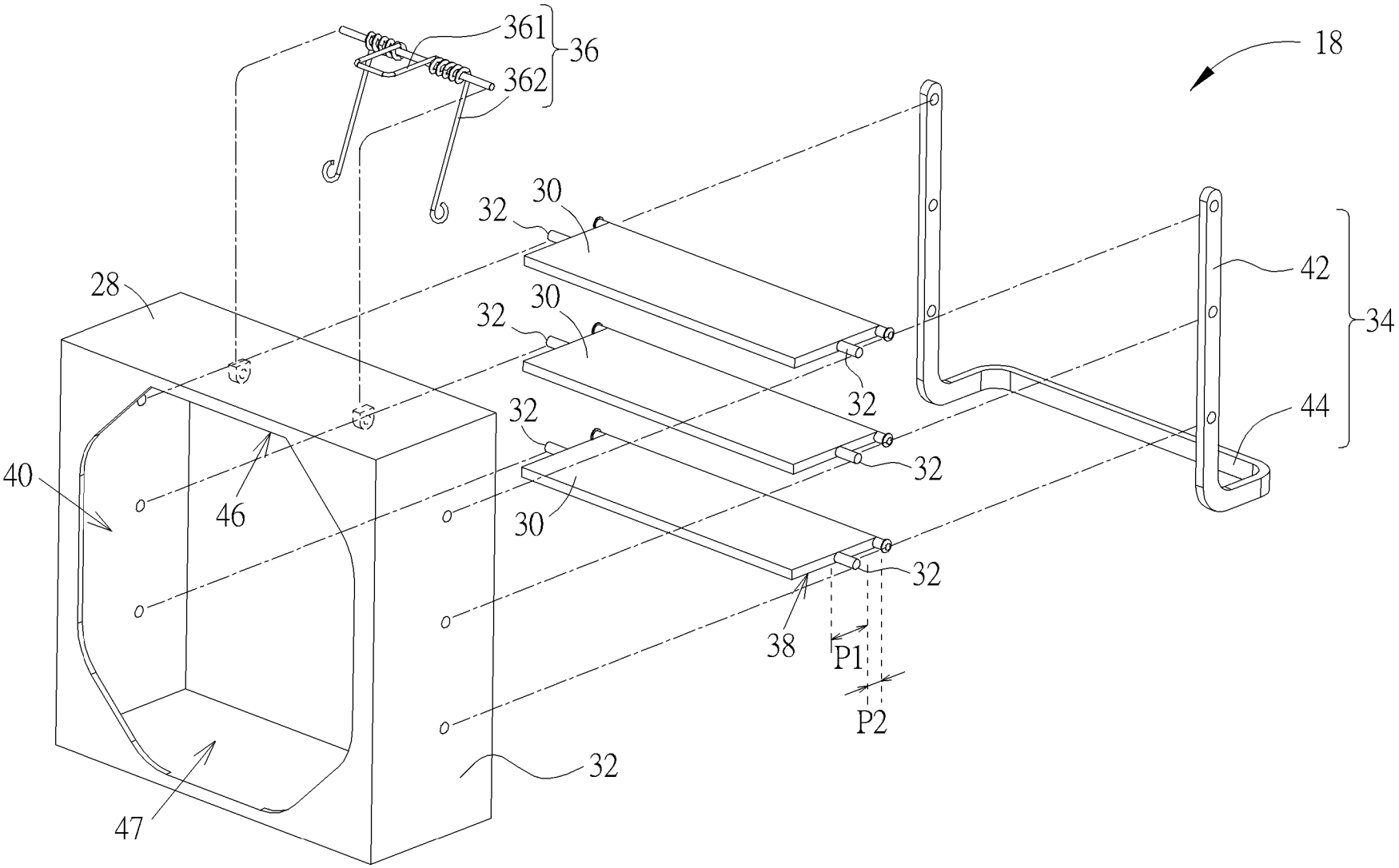
FIG. 4 is an exploded diagram of a window-shades mechanism in accordance with a first embodiment of the present disclosure.
Figure 5:
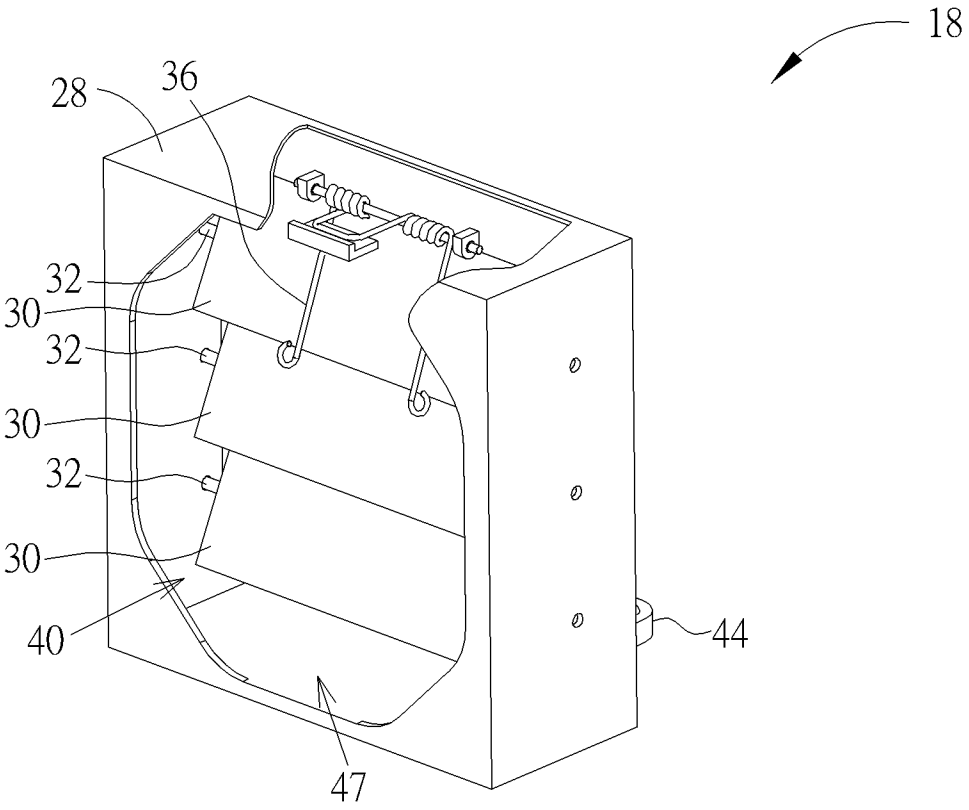
FIG. 5 and FIG. 6 are diagrams of the window-shades mechanism in different operation modes in accordance with the first embodiment of the present disclosure.
Figure 6:
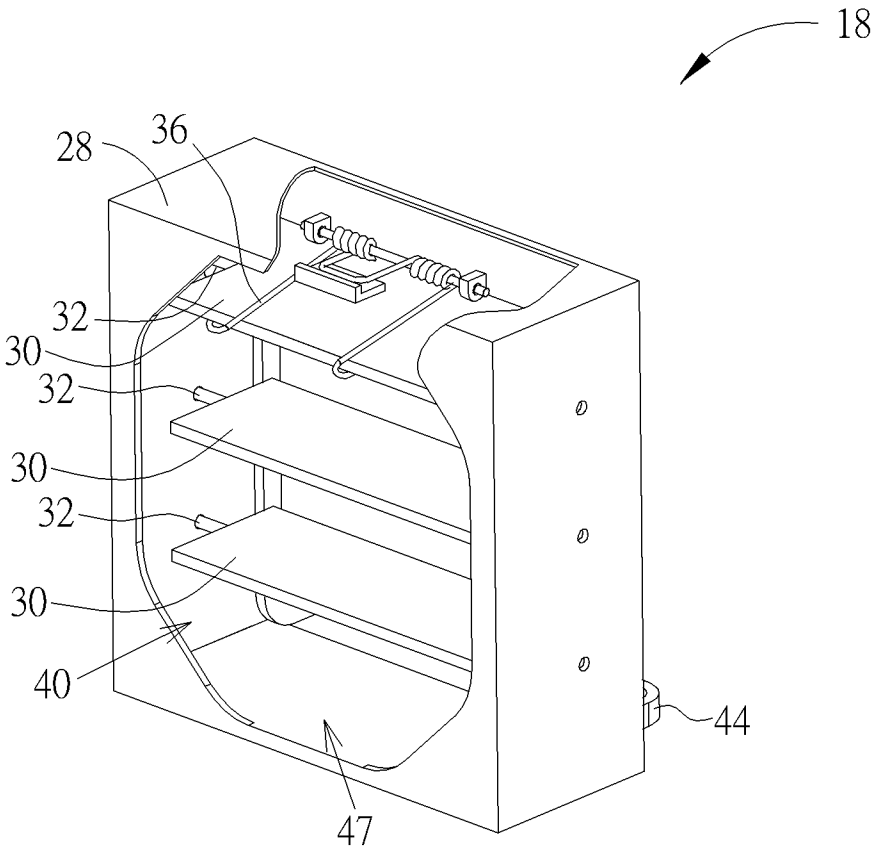

Please refer to FIG. 4 to FIG. 6. The window-shades mechanism 18 can include a supporter 28, the blade 30, a shaft 32, a connecting rod 34 and a resilient component 36. An amount and a shape of the blade 30 are not limited to the embodiment shown in the figures, and depend on design demand. The supporter 28 can be detachably disposed on the housing 16, or the supporter 28 can be integrated with the housing 16 monolithically. The supporter 28 can include an inner lateral wall 40, an inner top wall 46 and an inner bottom wall 47. A side 38 of the blade 30 can have a first region P1 and a second region P2. The first region P1 can be located on a middle region of the side 38, and the second region P2 can be located on a side region of the side 38.

The shaft 32 can be rotatably connected to the inner lateral wall 40 of the supporter 28 and pivotally connected to the first region P1 of the blade 30. The connecting rod 34 can be rotatably connected to the second region P2 of the blade 30. The shaft 32 is spaced from the connecting rod 34, and a distance between the shaft 32 and the connecting rod 34 can be a level of force when the connecting rod 34 is pressed, so that the blade 30 can be rotated relative to the shaft 32 along a clockwise direction or along a counterclockwise direction. The connecting rod 34 can include a bridging portion 42 and a holding portion 44 bend from each other. The bridging portion 42 can be pivotally connected to the blade 30, and the holding portion 44 can be configured to hold the fan unit 20. When the holding portion 44 is pressed downwardly by the fan unit 20, the holding portion 44 can move the blade 30 via the bridging portion 42, and the blade 30 can be rotated relative to the supporter 28 via the shaft 32. One end 361 of the resilient component 36 can contact against the inner top wall 46 of the supporter 28, and the other end 362 of the resilient component 36 can contact against blade 30.

As shown in FIG. 5, the blade 30 and the connecting rod 34 are in an original position. The blade 30 is lowered down to close the hole structure 26, and the connecting rod 34 is located at a higher position. When the fan unit 20 is installed into the housing 16, the fan unit 20 can press the holding portion 44 of the connecting rod 34 to move the connecting rod 34 downwardly. As shown in FIG. 6, the connecting rod 34 is moved downwardly to rotate the blade 30 along the clockwise direction to expose space between the blades 30, which means the blade 30 can be distant from the hole structure 26 to connect the first area R1, the second area R2 and the third area R3. In the meantime, the resilient component 36 is compressed to store a resilient recovering force. When the fan unit 20 is removed from the housing 16, pressure applied to the connecting rod 34 by the fan unit 20 is released, the resilient recovering force of the resilient component 36 can drive the blade 30 to rotate along the counterclockwise direction, and the connecting rod 34 can be moved upwardly and back to the original position shown in FIG. 5. Meanwhile, the space between the blades 30 is sheltered, which means the hole structure 26 can be covered by the blade 30, and the second area R2 is not connected to the first area R1 and the third area R3. The first area R1 and the third area R3 respectively form an independent barometric pressure area.

Figure 7:
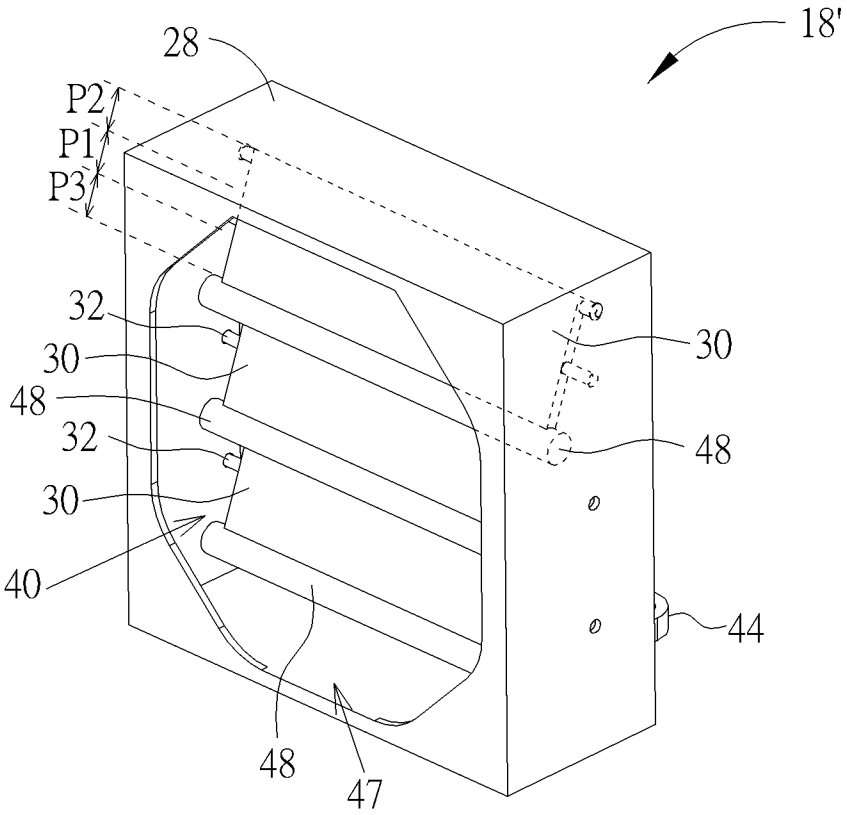
FIG. 7 and FIG. 8 are diagrams of the window-shades mechanism in different operation modes in accordance with a second embodiment of the present disclosure.
Figure 8:
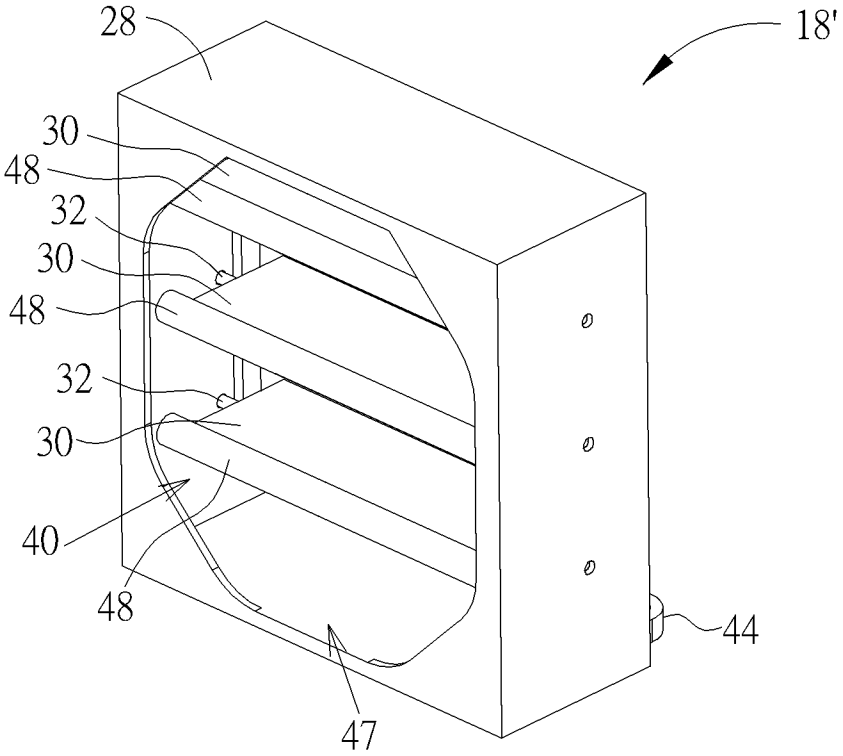

Please refer to FIG. 7 and FIG. 8. In a second embodiment, elements having the same numeral as ones of the first embodiment have the same structures and functions, and a detailed description is omitted herein for simplicity. The side 38 of the blade 30 of a window-shades mechanism 18' in the second embodiment can be divided into the first region P1, the second region P2 and a third region P3. The first region P1 can be located between the second region P2 and the third region P3. The third region P3 can be located on a side region of the side 38 opposite to the second region P2. The window-shades mechanism 18' can further include a weighting component 48 disposed on the third region P3. A weight of the weighting component 48 can be designed according to a length of the side 38 of the blade 30 and a weight of the connecting rod 34 as long as torque generated by the weighting component 48 and the shaft 32 is greater than torque generated by the connecting rod 34 and the shaft 32.

As shown in FIG. 7, the blade 30 and the connecting rod 34 are in the original position. When the fan unit 20 is installed into the housing 16, the fan unit 20 can press the holding portion 44 of the connecting rod 34, and the connecting rod 34 can be moved downwardly. As shown in FIG. 8, the fan unit 20 is moved downwardly to keep the connecting rod 34 in a lower position, and the connecting rod 34 can rotate the blade 30 along the clockwise direction to expose the space between the blades 30, and the first area R1, the second area R2 and the third area R3 are connected to each other. When the fan unit 20 is removed from the housing 16, the pressure applied to the connecting rod 34 by the fan unit 20 is released, and the weight of the weighting component 48 can drive the blade 30 to rotate along the counterclockwise direction and back to the original position, shown in FIG. 7, to cover the space between the blades 30.

Figure 9:
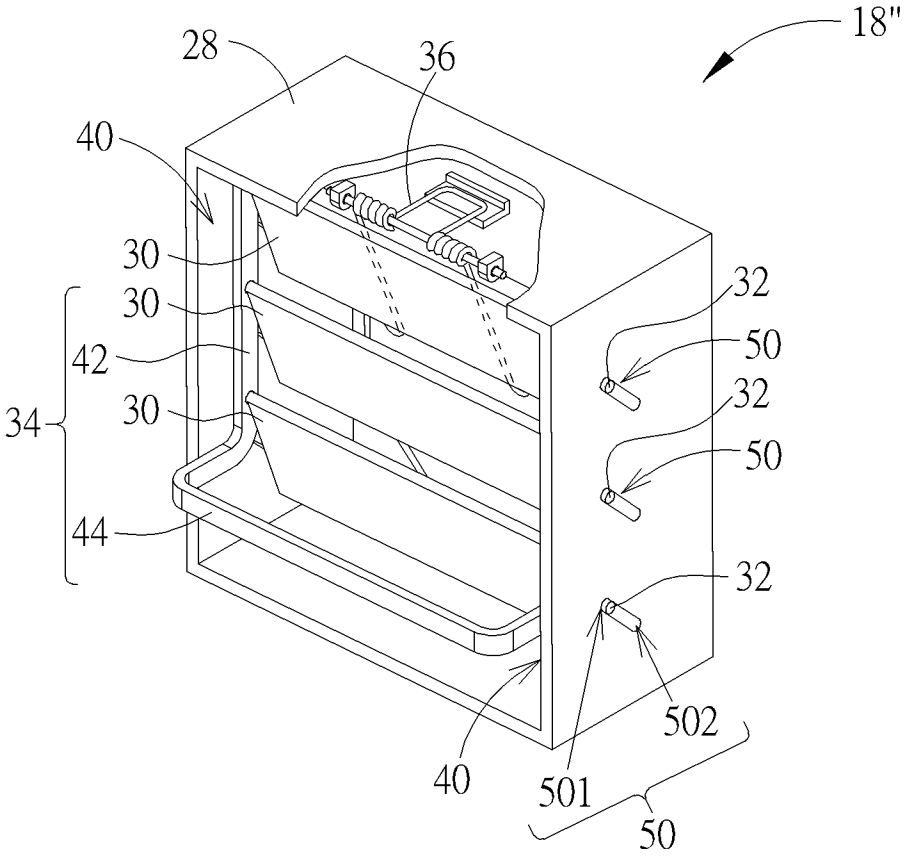
FIG. 9 and FIG. 10 are diagrams of the window-shades mechanism in different operation modes in accordance with a third embodiment of the present disclosure.
Figure 10:
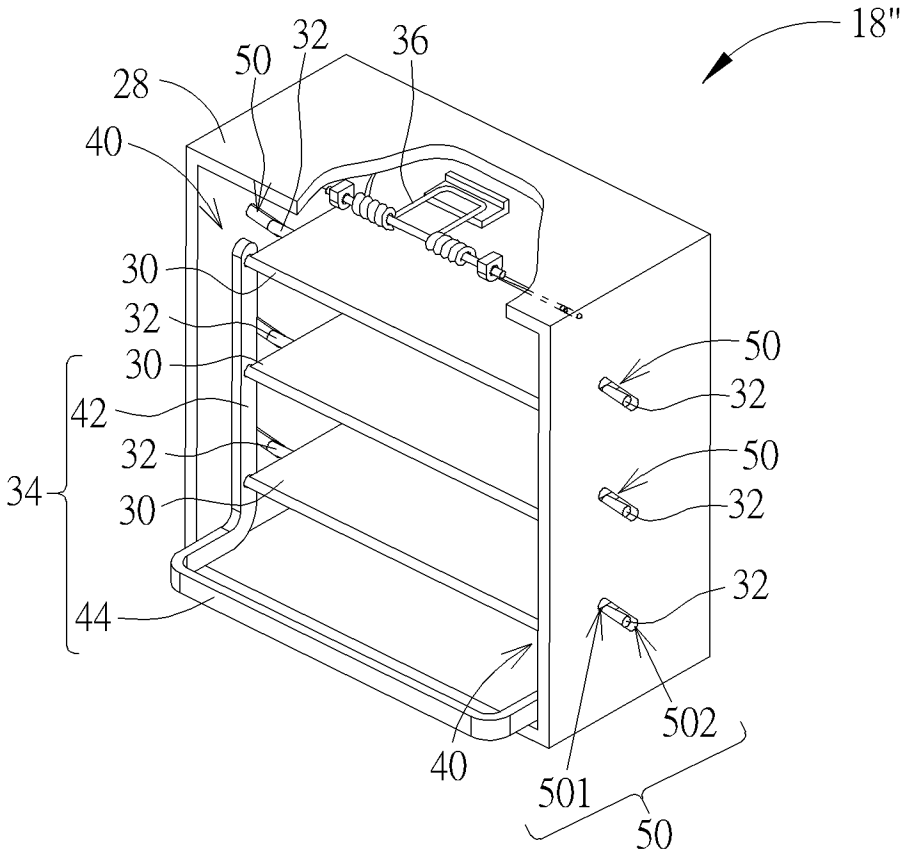

Please refer to FIG. 9 and FIG. 10. In a third embodiment, elements having the same numeral as ones of the above-mentioned embodiment have the same structures and functions, and a detailed description is omitted herein for simplicity. The supporter 28 of a window-shades mechanism 18" in the third embodiment can have a sliding slot structure 50 formed on the inner lateral wall 40 of the supporter 28. The shaft 32 can be disposed inside the sliding slot structure 50 in a slidable and rotatable manner. As shown in FIG. 9, the blade 30 and the connecting rod 34 are in the original position, and the shaft 32 is located on a top end 501 of the sliding slot structure 50. Meanwhile, the blade 30 is lowered down to cover the space between the blades 30. When the fan unit 20 is installed into the housing 16, the holding portion 44 can be pressed to move the connecting rod 34 downwardly. The blade 30 not only can rotate relative to the shaft 32 along the clockwise direction, but also can slide with the shaft 32 along the sliding slot structure 50 until the shaft 32 is moved to a bottom end 502 of the sliding slot structure 50, as shown in FIG. 10, as such, the blade 30 can be lifted to expose the space between the blades 30.

The window-shades mechanism 18" in the third embodiment can include the resilient component 36 configured between the supporter 28 and the blade 30. The resilient recovering force of the resilient component 36 can move the blade 30 from position shown in FIG. 10 to position shown in FIG. 9. Further, the window-shades mechanism 18" may dispose the weighting component 48 (such as the embodiment shown in FIG. 7 and FIG. 8) on the blade 30, so that the weight of the weighting component 48 can drive the blade 30 to move to the original position. The blade 30 in the first embodiment and the second embodiment cannot move relative to the supporter 28. When the connecting rod 34 is moved downwardly by the external force, the connecting rod 34 may be slightly moved along a horizontal direction, which means when the connecting rod 34 is moved downward, the connecting rod 34 may be moved to approach to the fan unit 20 simultaneously. When the connecting rod 34 is moved upwardly, the connecting rod 34 may be moved away from the fan unit 20 simultaneously. The blade 30 in the third embodiment can be moved inside the sliding slot structure 50 in the slidable and rotatable manner, thus the connecting rod 34 does not move along a horizontal direction when being lifted up and lowered down.

Figure 11:
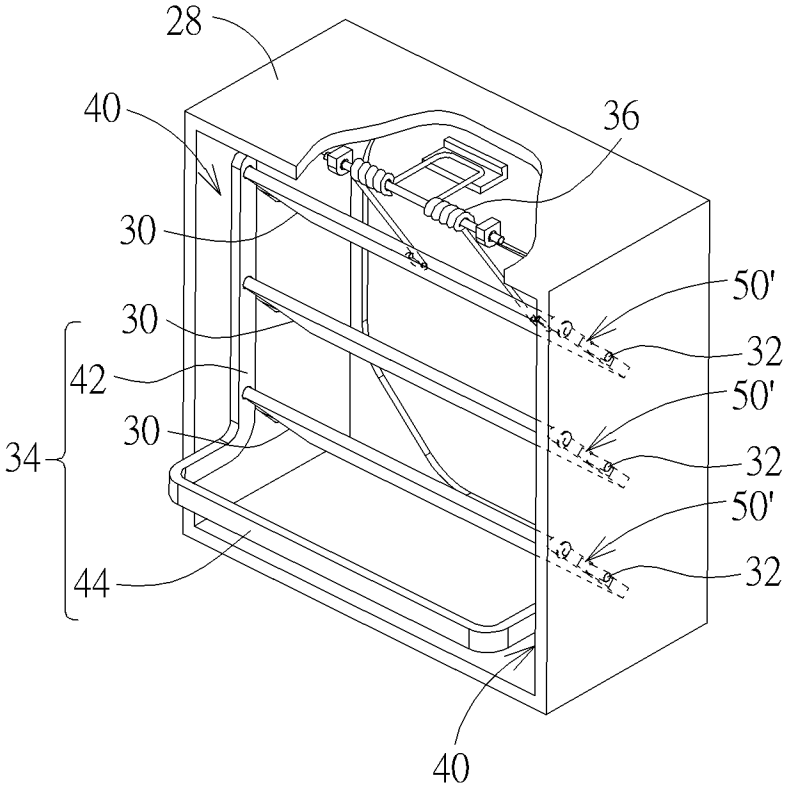
FIG. 11 is a diagram of a sliding slot structure in accordance with another embodiment of the present disclosure.

Please refer to FIG. 11. In this embodiment, elements having the same numeral as ones of the above-mentioned embodiments have the same structures and functions, and a detailed description is omitted herein for simplicity. A sliding slot structure 50' in this embodiment may be optionally disposed on the side 38 of the blade 30. One end of the shaft 32 can be connected to the inner lateral wall 40 of the supporter 28, and the other end of the shaft 32 can be disposed inside the sliding slot structure 50' of the blade 30 in the slidable and rotatable manner. With a movement of the connecting rod 34, the blade 30 can be rotated and shifted relative to the shaft 32 via the sliding slot structure 50'. The connecting rod 34 can be vertically moved to lift or lower down the blade 30 smoothly.

The sliding slot structure 50 and the sliding slot structure 50' illustrated in the above-mentioned embodiment are straight sliding slots, and an actual shape of the sliding slot may depend on design demand. The sliding slot structure 50 and the sliding slot structure 50' further can be designed as an arc sliding slot, or a sliding slot having a corner, or an elliptical sliding slot. Any sliding slot structure, which is capable of preventing the blade 30 from being moved out of the supporter 28 and have the related connecting rod 34 cooperate to operations of the fan unit 20, which indicate that the fan unit 20 being moved in or moved out from the housing 16, belong to a scope of the present disclosure.

Figure 12:
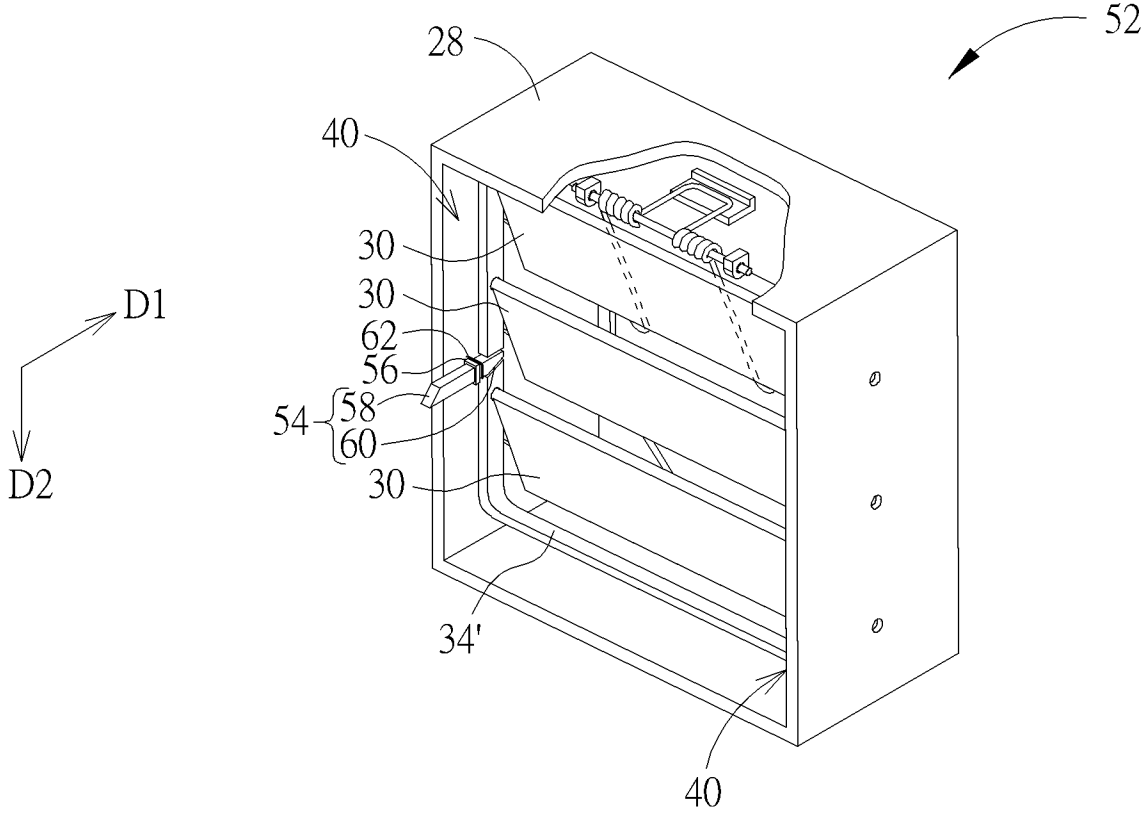
FIG. 12 is a diagram of the window-shades mechanism in accordance with a fourth embodiment of the present disclosure.

Please refer to FIG. 12. In a fourth embodiment, elements having the same numeral as ones of the above-mentioned embodiments have the same structures and functions, and a detailed description is omitted herein for simplicity. A window-shades mechanism 52 in the fourth embodiment can include an actuating component 54 movably disposed on the supporter 28. For example, the supporter 28 can include a constraining structure 56 disposed on the inner lateral wall 40. The constraining structure 56 can be a sleeve or a collar, which depends on design demand. The actuating component 54 can be slidably disposed inside the constraining structure 56. The actuating component 54 can include a pressed portion 58 and a pressing portion 60 connected to each other. The fan unit 20 is installed into the housing 16 to press the pressed portion 58, and then the pressing portion 60 can be driven to move a connecting rod 34'. As shown in FIG. 12, the pressing portion 60 and the connecting rod 34' respectively can have an inclined guiding surface structure. When the pressing portion 60 is moved toward the connecting rod 34' along the first direction D1, relative motion between two inclined guiding surface structures can move the connecting rod 34' along the second direction D2. The first direction D1 can be preferably perpendicular to the second direction D2, however an included angle between the first direction D1 and the second direction D2 depends on angles of two inclined guiding surfaces on the inclined guiding surface structures, and an actual application of actuating component 54 is not limited to the above-mentioned embodiment.

The window-shades mechanism 52 can optionally include a recovering component 62 disposed on the actuating component 54 and contacting against the constraining structure 56. When the fan unit 20 is removed from the housing 16, a resilient recovering force of the recovering component 62 can push the actuating component 54 toward a direction opposite to the first direction D1 for recovery. The inclined guiding surfaces on the pressing portion 60 and the connecting rod 34' in the foresaid embodiment are plane surfaces. However, the present disclosure further can design the pressing portion 60 as an inclined guiding convex structure and design the connecting rod 34' as an inclined guiding concave structure, or design the pressing portion 60 as the inclined guiding concave structure and design the connecting rod 34' as the inclined guiding convex structure. The pressed portion 58 may have the inclined guiding surface structure. When the fan unit 20 is installed into the housing 16 to press the pressed portion 58, the actuating component 54 can be moved by a horizontal component applied to the inclined guiding surface structure of the pressed portion 58, and the connecting rod 34' can be lifted or lowered down due to motion of the actuating component 54.

In view of the above, the window-shades mechanism of the present disclosure can connect the connecting rod with the plurality of blades, and the plurality of blades can be simultaneously and automatically rotated when the connecting rod is pushed by the fan unit. The blades can be automatically recovered in response to a removal of the fan unit. It should be mentioned that the window-shades mechanism can utilize one of the resilient component and the weighting component to recover the blades, or can utilize both the resilient component and the weighting component to recover the blades. The fan device can be configured to hold the plurality of fan units. Even if some of the plurality of fan units may be removed, the window-shades mechanism without the corresponding fan unit can automatically lower down the blade, so that two independent barometric pressure areas respectively setting on two opposite sides of the fan device can keep stable barometric pressure, so as to provide preferred heat dissipating efficiency without airflow interference or backflow.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A window-shades mechanism with an anti-backflow function, comprising:

a supporter;

a blade disposed inside the supporter and comprising two sides, each side having a first region and a second region adjacent to each other;

a shaft connected to the supporter and the first region of the two sides of the blade; and a connecting rod, two sections of the connecting rod being respectively connected to the second regions of the two sides of the blade, the connecting rod having a holding portion, and the connecting rod rotating the blade relative to the supporter via the shaft when the holding portion is moved by weight of a fan unit.

2. The window-shades mechanism of claim 1, comprising:

a resilient component, an end of the resilient component contacting against the supporter, and the other end of the resilient component contacting against the blade.

3. The window-shades mechanism of claim 1, comprising:

a weighting component disposed on a third region on the two sides, and the first region being located between the second region and the third region.

4. The window-shades mechanism of claim 1, wherein the blade comprises a sliding slot structure formed on at least one of the two sides, and the shaft is disposed inside the sliding slot structure in a slidable and rotatable manner.

5. The window-shades mechanism of claim 1, wherein the supporter comprises a sliding slot structure formed on an inner lateral wall of the supporter, and the shaft is disposed inside the sliding slot structure in a slidable and rotatable manner.

6. The window-shades mechanism of claim 1, comprising:

an actuating component movably disposed on the supporter, the actuating component comprising a pressed portion and a pressing portion connected to each other, the pressing portion pushing the connecting rod when the pressed portion is pressed by the weight of the fan unit.

7. The window-shades mechanism of claim 6, wherein the pressing portion and the connecting rod respectively comprises an inclined guiding surface structure, when the pressing portion slides relative to the connecting rod along a first direction, the connecting rod is moved along a second direction, different from the first direction, via the inclined guiding surface structures.

8. A fan device with an anti-backflow function, comprising:

a housing, having a first wall and a second wall opposite to each other, the first wall and the second wall respectively comprising a hole structure;

at least one window-shades mechanism disposed on one of the first wall and the second wall and corresponding to the hole structures, wherein the window-shades mechanism comprises:

a supporter connected to the housing;

a blade disposed inside the supporter and comprising two sides, each side having a first region and a second region adjacent to each other;

a shaft connected to the supporter and the first region of the two sides of the blade; and a connecting rod connected to the second region of the two sides of the blade, and the connecting rod having a holding portion; and a fan unit detachably disposed inside the housing, the connecting rod rotating the blade relative to the supporter via the shaft when the fan unit presses the holding portion to move the connecting rod.

9. The fan device of claim 8, wherein the window-shades mechanism further comprises a resilient component, an end of the resilient component contacts against the supporter and the other end of the resilient component contacts against the blade, and a resilient recovering force of the resilient component drives the blade back to an original position.

10. The fan device of claim 8, wherein the window-shades mechanism further comprises a weighting component disposed on a third region on the two sides, the first region is located between the second region and the third region, and the weighting component drives the blade back to an original position.

11. The fan device of claim 8, wherein the blade comprises a sliding slot structure formed on at least one of the two sides of the blade, and the shaft is disposed inside the sliding slot structure in a slidable and rotatable manner.

12. The fan device of claim 8, wherein the supporter comprises a sliding slot structure formed on an inner lateral wall of the supporter, and the shaft is disposed inside the sliding slot structure in a slidable and rotatable manner.

13. The fan device of claim 8, wherein the window-shades mechanism further comprises an actuating component movably disposed on the supporter, the actuating component comprises a pressed portion and a pressing portion connected to each other, the pressing portion pushes the connecting rod when the pressed portion is pressed by the external force.

14. The fan device of claim 13, wherein the pressing portion and the connecting rod respectively comprises an inclined guiding surface structure, when the pressing portion slides relative to the connecting rod along a first direction, the connecting rod is moved along a second direction, different from the first direction, via the inclined guiding surface structures.

15. An electronic apparatus with an anti-backflow function, comprising:

a base, having a first area, a second area and a third area connected to each other; and a fan device disposed on the second area, wherein the fan device comprises:

a housing, having a first wall and a second wall opposite to each other, the first wall and the second wall respectively comprising a hole structure;

at least one window-shades mechanism disposed on one of the first wall and the second wall and corresponding to the hole structures, wherein the window-shades mechanism comprises:

a supporter connected to the housing;

a blade disposed inside the supporter and comprising two sides, each side having a first region and a second region adjacent to each other;

a shaft connected to the supporter and the first region of the two sides of the blade;

a connecting rod connected to the second region of the two sides of the blade, and the connecting rod having a holding portion; and a fan unit detachably disposed inside the housing and located between the hole structures of the first wall and the second wall, the connecting rod driving the blade to rotate relative to the supporter via the shaft when the fan unit presses the holding portion and moves the connecting rod, so as to move the blade away from the hold structures and to connect the first area and the third area.

16. The electronic apparatus of claim 15, wherein the window-shades mechanism further comprises a resilient component, an end of the resilient component contacts against the supporter and the other end of the resilient component contacts against the blade, and a resilient recovering force of the resilient component drives the blade back to an original position.

17. The electronic apparatus of claim 15, wherein the window-shades mechanism further comprises a weighting component disposed on a third region on the two sides, the first region is located between the second region and the third region, and the weighting component drives the blade back to an original position.

18. The electronic apparatus of claim 15, wherein the blade comprises a sliding slot structure formed on at least one of the two sides of the blade, and the shaft is disposed inside the sliding slot structure in a slidable and rotatable manner.

19. The electronic apparatus of claim 15, wherein the supporter comprises a sliding slot structure formed on an inner lateral wall of the supporter, and the shaft is disposed inside the sliding slot structure in a slidable and rotatable manner.

20. The electronic apparatus of claim 15, wherein the window-shades mechanism further comprises an actuating component movably disposed on the supporter, the actuating component comprises a pressed portion and a pressing portion connected to each other, the pressing portion pushes the connecting rod when the pressed portion is pressed by the external force.

* * * * *